United States Patent [19]

Copperi et al.

[11] Patent Number: 4,791,670

[45] Date of Patent: Dec. 13, 1988

[54] METHOD OF AND DEVICE FOR SPEECH SIGNAL CODING AND DECODING BY VECTOR QUANTIZATION TECHNIQUES

[75] Inventors: Maurizio Copperi, Venaria; Daniele Sereno, Vercelli, both of Italy

[73] Assignee: Cselt - Centro Studi e Laboratori Telecomunicazioni SpA, Turin, Italy

[21] Appl. No.: 779,089

[22] Filed: Sep. 20, 1985

[30] Foreign Application Priority Data

Nov. 13, 1984 [IT] Italy ..... 68134 A/84

[51] Int. Cl.[4] ..... G10L 5/00

[52] U.S. Cl. ..... 381/41; 381/43; 381/51; 364/513.5

[58] Field of Search ..... 381/36, 41, 43, 46, 381/51; 364/513, 513.5, 518; 358/12, 21 R

[56] References Cited

U.S. PATENT DOCUMENTS 4,670,851 6/1987 Murakami et al. ..... 358/12 X

FOREIGN PATENT DOCUMENTS

WO85/04276 9/1985 PCT Int'l Appl. ..... 381/41
2150377 6/1985 United Kingdom ..... 381/41

OTHER PUBLICATIONS

"Distortion Performance of Vector Quantization for LPC Voice Coding", Biing-Hwang Juang et al-pp. 294-303.

"A New Model of LPC Excitation for Producing Natural-Sounding Speech at Low Bit Rates", B. S. Atal et al, pp. 614-617.

IEEE Transactions on Communications, vol. Com. 30, No. 4, Apr. 1982, A Multirate Voice Digitizer Based upon Vector Quantization by Guillermo Rebolledo, Member IEEE et al. pp. 721-727.

*Primary Examiner*—Patrick R. Salce
*Assistant Examiner*—Emanuel Todd Voeltz
*Attorney, Agent, or Firm*—Herbert Dubno

[57] ABSTRACT

This method provides a filtering of digital samples of speech signal by a linear-prediction inverse filter, whose coefficients are chosen out of a codebook of quantized filter coefficient vectors, obtaining a residual signal subdivided into vectors. The weighted mean-square error made in quantizing said vectors with quantized residual vectors contained in a codebook and forming excitation waveforms is computed.

The coding signal for each block of samples consists of the coefficient vector index chosen for the inverse filter as well as of the indices of the vectors of the excitation waveforms which have generated minimum weighted mean-square error. During the decoding phase, a synthesis filter, having the same coefficients as chosen for the inverse filter, is excited by quantized-residual vectors chosen during the coding phase (FIGS. 1, 2).

7 Claims, 3 Drawing Sheets

METHOD OF AND DEVICE FOR SPEECH SIGNAL CODING AND DECODING BY VECTOR QUANTIZATION TECHNIQUES

FIELD OF THE INVENTION

The present invention relates to low-bit rate speech signal coders and, more particularly, to a method of and an apparatus for speech-signal coding and decoding by vector quantization techniques.

BACKGROUND OF THE INVENTION

Conventional devices for speech-signal coding, usually known in the art as "Vocoders", use a speech synthesis method providing the excitation of a synthesis filter, whose transfer function simulates the frequency behavior of the vocal tract with pulse trains at pitch frequency for voiced sounds or in the form of white noise for unvoiced sounds.

This excitation technique is not very accurate. In fact, the choice between pitch pulses and white noise is too stringent and introduces a high degree of degradation of reproduced-sound quality.

Besides, both the voiced-unvoiced sound decision and the pitch value are difficult to determine.

A method known for exciting the synthesis filter, intended to overcome the disadvantages above, is described in the paper by B. S. Atal and J. R. Remde, "*A New Model of LPC Excitation for Producing Natural-Sounding Speech at Low Bit Rates,* International Conference on ASSP, pp. 614–617, Paris 1982.

This method uses a multi-pulse excitation, i.e. an excitation consisting of a train of pulses whose amplitudes and positions in time are determined so as to minimize a perceptually-meaningful distortion measurement. The distortion measurement is obtained by a comparison between the synthesis filter output samples and the speech samples, and by weighting by a function which takes account of how human auditory perception evaluates the introduced distortion.

Nevertheless, this method cannot offer good reproduction quality at a bit-rate lower than 10 kbit/s. In addition excitation-pulse computing algorithms require an unsatisfactorily high number of computations.

OBJECT OF THE INVENTION

It is the object of the present invention to provide an improved speech-signal coding method which requires neither pitch measurement, nor voiced-unvoiced sound decision, but, by vector-quantization techniques and perceptual subjective distortion measures, generates quantized waveform codebooks wherefrom excitation vectors as well as linear-prediction filter coefficients can be chosen both in transmission and reception.

SUMMARY OF THE INVENTION

This object is attained, in accordance with the invention with a method of speech-signal coding and decoding in which the speech signal is subdivided into time intervals and converted into blocks of digital-samples x(j). For speech-signal coding each block of samples x(j) undergoes a linear-prediction inverse filtering operation. We can choose from a codebook of quantized filter coefficient vectors $a_h(i)$, the vector of index $h_{ott}$ forming the optimum filter which minimizes a spectral-distance function $d_{LR}$ among normalized gain linear-prediction filters and obtain a residual signal R(j) subdivided into residual vectors R(k). Each of these vectors is then compared to each vector of a codebook of quantized residual vectors $R_n(k)$, obtaining N difference vectors $E_n(k)$ $(1<n<N)$ which are then subjected to a filtering operation according to a frequency weighting function W(z). Filtered quantization error vectors $\hat{E}_n(k)$, are extracted and for each a mean-square error $mse_n$ is then computed.

Indices $n_{min}$ of quantized residual vectors $R_n(k)$ which have generated a minimal value of $mse_n$, one for each residual vector R(k), and index $h_{ott}$ forming the coded speech signal for a block of samples x(j) are used. For speech signal decoding, quantized residual vectors $R_n(k)$ having index $n_{min}$ are chosen, the vectors undergoing a linear-prediction filtering operation by choosing, as coefficients, vectors $a_h(i)$ having index $h_{ott}$ and obtaining thereby quantized digital samples $\hat{x}(j)$ of a reconstructed speech signal.

The apparatus for speech-signal coding and decoding can comprise at an input of a coding side in transmission a low-pass filter and an analog-to-digital converter to obtain said blocks of digital samples x(j), and at an output of a decoding side in reception a digital-to-analog converter to obtain the reconstructed speech signal. The speech-signal coding part comprises:

a first register to temporarily store the blocks of digital samples it receives from the analog-to-digital converter;

a first computing circuit of an autocorrelation coefficient vector $C_x(i)$ of digital samples for each block of the samples it receives from the first register;

a first read-only memory containing H autocorrelation coefficient vectors $C_a(i,h)$ of the quantized filter coefficients $a_h(i)$, where $1<h<H$;

a second computing circuit determining the spectral distance function $d_{LR}$ for each vector of coefficients $C_x(i)$ which it receives from the first computing circuit and for each vector of coefficients $C_a(i,h)$ it receives from the first memory, and determining the minimum of H values of $d_{LR}$ obtained for each vector of coefficients $C_x(i)$ and supplying to the output the corresponding index $h_{ott}$;

a second read-only memory containing the codebook of vectors of quantized filter coefficients $a_h(i)$, addressed by the indices $h_{ott}$;

a first linear-prediction inverse digital filter which receives the blocks of samples from the first register BF1 and the vectors of coefficients $a_h(i)$ from the second memory, and generates the residual signal R(j) supplied to a second register which temporarily stores it and supplies the residual vectors R(k);

a third read-only memory containing the codebook of quantized-residual vectors $R_n(k)$;

a subtracting circuit computing for each residual vector R(k), supplied by the second register, the differences with respect to each vector supplied by the third memory;

a second linear-prediction digital filter executing the frequency weighting W(z) of the vectors received from the subtracting circuit, obtaining the vector of filtered quantization error $\hat{E}_n(k)$;

a third computing circuit of the mean-square error $mse_n$ relating to each vector $\hat{E}_n(k)$ received from the second digital filter;

a comparison circuit identifying, for each residual vector R(k), the minimum mean-square error of vectors $\hat{E}_n(k)$ it receives from the third computing circuit, and supplying to the output the corresponding index $n_{min}$; and a third register supplying the output with the coded speech signal composed, for each block of samples x(j), of the indices $n_{min}$, and $h_{ott}$, the latter being received through a first delay circuit from said second computing circuit.

For speech-signal decoding, the apparatus comprises:

a fourth register which temporarily stores a coded speech signal which it receives at an input and supplies as addresses the indices $h_{ott}$ to the secondary memory and the indices $n_{min}$ to the third memory; and a third digital filter of the linear prediction type which receives from said second and third memory addressed by said fourth register, respectively the vectors of coefficients $a_h(i)$ and quantized residual $R_n(k)$ and supplies to said digital-to-analog converter the quantized digital samples $\hat{x}(j)$.

Advantageously the second digital filter computes it vectors of coefficients $\gamma^i.a_h(i)$ by multiplying by constant values $\gamma^i$ the coefficient vectors $a_h(i)$ it receives from said secondary memory through a second delay circuit.

BRIEF DESCRIPTION OF THE DRAWING

The above and other objects, features and advantages of the present invention will become more readily apparent from the following description, reference being made to the accompanying drawing in which.

SPECIFIC DESCRIPTION

The method of the invention, providing a coding phase of the speech signal in transmission and a decoding phase or speech snythesis in reception, will be now described.

Figure 1:
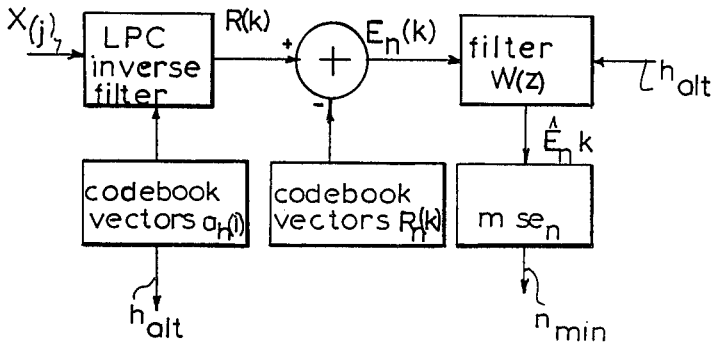
FIGS. 1 and 2 are block diagrams relating to the method of coding in transmission and decoding in reception the speech signal.

With reference to FIG. 1, in transmission the speech signal is converted into blocks of digital samples x(j), with j=index of the sample in the block ($1<j<J$).

The blocks of digital samples x(j) are then filtered according to the known technique of linear-prediction inverse filtering, or LPC inverse filtering with a transfer function H(z), in the Z transform, is in a non-limiting example:

$$H(z) = \sum_{i=0}^{L} a(i) \cdot z^{-1} = 1 + \sum_{i=1}^{L} a(i) \cdot z^{-1} \quad (1)$$

where $z^{-1}$ represents a delay of one sampling interval; a(i) is a vector of linear-prediction coefficients ($0<i<L$); L is the filter order and also the size of vector a(i), a(O) being equal to 1.

Coefficient vector a(i) must be determined for each block of digital samples x(j). In accordance with the present invention the vector is chosen, as will be described hereinafter, from a codebook of vectors of quantized linear-prediction coefficients $a_h(i)$ where h is the vector index in the codebook ($1<h<H$).

The vector chosen allows, for each block of samples x(j), the optimal inverse filter to be built up; the chosen vector index will be hereinafter denoted by $h_{ott}$.

As a filtering effect, for each block of samples x(j), a residual signal R(j) is obtained which is subdivided into a group of residual vectors R(k), with $1<k<K$, where K is an integer submultiple of J.

Each residual vector R(k) is compared with all quantized-residual vectors $R_n(k)$ belonging to a codebook generated in a way which will be described hereinafter; n, where ($1<n<N$), is the index of quantized-residual vector of the codebook.

The comparison generates a sequence of differences of quantization error vectors $E_n(k)$ which are filtered by a shaping filter having a transfer function w(k) defined hereinafter.

The mean-square error $mse_n$ generated by each filtered quantization error $\hat{E}_n(k)$ is calculated. Mean-square error is given by the following relation:

$$mse_n = \frac{1}{K} \sum_{k=1}^{K} \hat{E}_n^2(k) \quad (2)$$

For each series of N comparisons relating to each vector R(k) the quantized-residual vector $R_n(k)$ which has generated minimum error $mse_n$ is identified. Vectors $R_n(k)$ identified for each residual R(j) are chosen as an excitation waveform in reception. For that reason the vectors $R_n(k)$ can be also referred to as excitation vectors. Indices of vectors $R_n(k)$ chosen will be hereinafter denoted by $n_{min}$.

The speech coding signal consists, for each block of samples x(j), of indices $n_{min}$ and of index $h_{ott}$.

Figure 2:
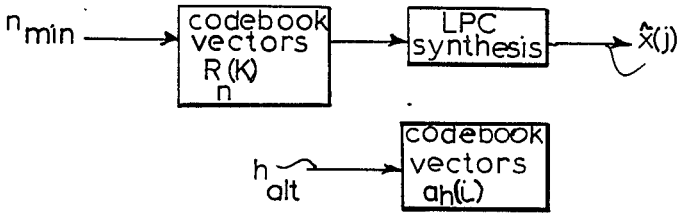

With reference to FIG. 2, during reception, quantized-residual vectors $R_n(k)$ having indices $n_{min}$ are selected from a codebook equivalent to the transmission codebook. The selected vectors $R_n(k)$, forming the excitation vectors, are then filtered by a linear-prediction filtering technique, using a transfer function $S(z)=1/H(z)$.

Coefficients a(i) appearing in S(z) are selected from a codebook equivalent to the transmission codebook of the filter coefficients $a_h(i)$ by using indices $h_{ott}$ received.

By filtering, quantized digital samples $\hat{x}(j)$ are obtained which, reconverted into analog form give the reconstructed speech signal.

The shaping filter of transfer function W(z) in the transmitter is intended to shape, in the frequency domain, quantization error $E_n(k)$, so that the signal reconstructed at the receiver utilizing the selected indices $R_n(k)$ is subjectively similar to the original signal. In fact the property of frequency-masking of a secondary undesired sound (noise) by a primary sound (voice) is exploited; at the frequencies at which the speech signal has high energy, i.e. in the neighborhood of resonance frequencies (formants), the ear cannot hear even high-intensity sounds.

By contrast, in the gaps between formants and where the speech signal has low energy (i.e. near the higher frequencies of the speech spectrum) quantization noise, whose spectrum is typically uniform, becomes perceptibly audible and degrades subjective quality.

Then the shaping filter will have a transfer function W(z) of the type of S(z) used in reception, but with a bandwidth in the neighborhood of resonance frequencies so increased as to introduce noise de-emphasis in high speech energy zones.

If $a_h(i)$ are the coefficients in S(z), then:

$$W(z) = \frac{1}{1 - \sum_{i=1}^{L} a_h(i) \cdot \gamma^i \cdot z^{-i}} \quad (3)$$

where $\gamma(0<\gamma<1)$ is an experimentally determined corrective factor which determines the bandwidth increase around the formants; the indices h used are still indices $h_{ott}$.

The technique used for the generation of the codebook of vectors of quantized linear-prediction coefficients $a_h(i)$ is the known vector quantization technique by measurement and minimization of the spectral distance $d_{LR}$ between normalized-gain linear prediction filters (likelihood ratio measure) described by instance in the paper by B. H. Juang, D. Y. Wong and A. H. Gray "*Distortion Performance of Vector Quantization for LPC Voice Coding*", IEEE Transactions in ASSP, vol. 30, n. 2, pp. 194–303, April 1982.

The same technique is also used for the choice of the coefficient vector $a_h(i)$ in the codebook during the coding phases in transmission.

This coefficient vector $a_h(i)$, which allows the building of the optimal LPC inverse filter, is that which allows the minimization of spectral distance $d_{LR}(h)$ derived from the relation:

$$d_{LR}(h) = \frac{\sum_{i=-L}^{L} C_a(i,h) \cdot C_x(i)}{\sum_{i=-L}^{L} C^*_a(i) \cdot C_x(i)} - 1 \quad (4)$$

where $C_x(i)$, $C_a(i,h)$, $C^*_a(i)$ are the autocorrelation coefficient vectors respectively of blocks of digital samples x(j), of coefficients $a_h(i)$ of generic LPC filter of the codebook, and of filter coefficients calculated by using current samples x(j).

Minimization of the distance $d_{LR}(h)$ is equivalent to finding the minimum of the numerator of the fraction in relation (4), since the denominator only depends on input samples x(j). Vectors $C_x(i)$ are computed starting from the input samples x(j) of each block previously weighted according to the known Hamming curve with a length of F samples and a superposition between consecutive windows such as to consider F consecutive samples centered around the J samples of each block.

Vector $C_x(i)$ is given by the relation:

$$C_x(i) = \sum_{j=1}^{F-M} x(j) \cdot x(j+i) \quad (5)$$

Vectors $C_a(i,h)$ are extracted from a corresponding codebook in one-to-one correspondence with the codebook of vectors $a_h(i)$.

Vectors $C_a(i,h)$ are derived from the following relation:

$$C_a(i,h) = \begin{cases} \sum_{q=0}^{L-1} a_h(q) \cdot a_h(q+i) \\ 0 \text{ for } i > L \end{cases} \quad (6)$$

For each value h, the numerator of the fraction present in relation (4) is calculated using relations (5) and (6); the index $h_{ott}$ supplying minimum value $d_{LR}(h)$ is used to choose vector $a_h(i)$ out of the relevant codebook.

Figure 3:
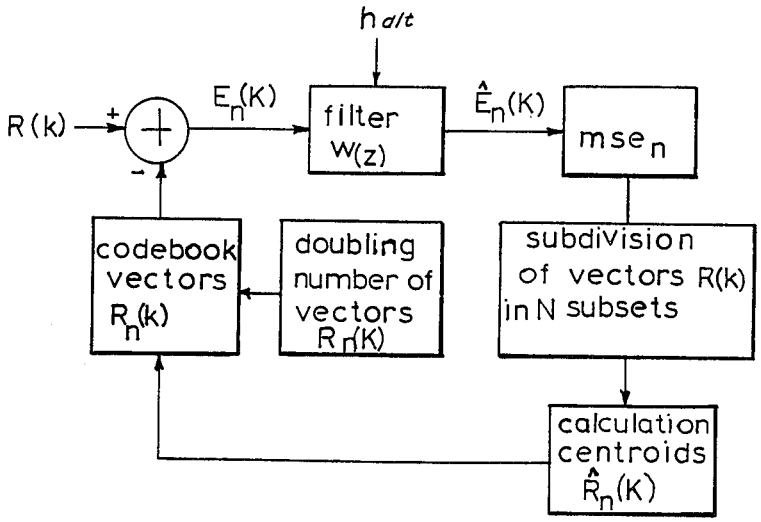
FIG. 3 is a block diagram concerning the method of generation of excitation vector codebook.

The method of generation of the codebook of quantized-residual vectors or excitation vectors $R_n(k)$ is now described with reference to FIG. 3.

To start, a training sequence is created, i.e. a sufficiently long speech signal sequence (e.g. 20 minutes) with a lot of different sounds pronounced by a plurality of people.

By using the above-described linear-prediction inverse filtering technique, from said training sequence a set of residual vectors R(k) is obtained, which in this way contains the short-time excitations of all significant sounds. By "short-time" we mean a time corresponding to the dimension of said residual vectors R(k); in such time period in fact the information in pitch, voiced/unvoiced sound, transitions between classes of sounds (vowel/consonant, consonant/consonant etc . . . ) can be present.

The starting point is an initial condition in which the codebook to be generated already contains two vectors $R_n(k)$ (in this case N=2) which can be randomly chosen (e.g. they can be two residual vectors R(k) of the corresponding set, or calculated as a mean of consecutive residual vectors R(k)).

The two initial vectors $R_n(k)$ are used to quantize the set of residual vectors R(k) by a procedure very similar to the one described above for speech signal coding in transmission, and which consists of the following steps:

for each residual vector R(k) there are calculated quantization error vectors $E_n(k)$ (n=1,2) by using vectors $R_n(k)$ of the codebook;

vectors $E_n(k)$ are filtered by filter W(z) defined in relation (3) obtaining filtered quantization-error vectors $\hat{E}_n(k)$;

for each residual vector R(k) there are calculated weighted mean-square errors $mse_n$ associated with each $E_n(k)$, using formula (2);

residual vector R(k) is associated with vector $R_n(k)$ which has generated the lowest error $mse_n$; and at each new residual R(j), i.e. for each residual vector group R(k), the coefficient vector $a_h(i)$ of filters H(z) and W(z) is updated.

The preceding steps are repeated for each vector R(k) of the training sequence. Finally, vectors R(k) are subdivided into N subsets; each of the subsets, associated with a vector $R_n(k)$, will contain a certain number m ($1<m<M$) of residual vectors $\hat{R}_m(k)$, where the value M depends on the subset considered, and hence on the obtained subdivision.

For each subset n, a centroid $R_n(k)$ is calculated as defined by the following relation:

$$\hat{R}_n(k) = \frac{\sum_{m=1}^{M} P_m \cdot R_m(k)}{\sum_{M=1}^{M} P_m} \quad (7)$$

where M is the number of residual vectors $R_m(k)$ belonging to the n-th subset; $P_m$ is a weighting coefficient of the m-th vector $R_m(k)$ computed by the following relation:

$$P_m = \frac{\sum_{k=1}^{K} [\hat{E}_{nm}(k)]^2}{\sum_{k=1}^{K} [E_{nm}(k)]^2} \quad (8)$$

$P_m$ is the ratio between the energies at the output and at the input of filter W(z) for a given pair of vectors $R_m(k)$, $R_n(k)$.

The N centroids $\hat{R}_n(k)$ thus obtained form the codebook of quantized-residual vectors $R_n(k)$ which replaces the preceding one.

The operations described till now are repeated for a certain number NI of subsequent iterations till the new codebook of vectors $R_n(k)$ no longer basically differs from the preceding codebook. Thus the optimal codebook of vectors $R_n(k)$ is determined for N=2, i.e. for a coding requiring 1 bit for each vector R(k).

Then the optimum codebook of vectors $R_n(k)$ for N=4 is determined: the starting point is a codebook consisting of two vectors $R_n(k)$ of the optimum codebook for N=2, and of two other vectors obtained from the preceding ones by multiplying all their components by a factor $(1+\epsilon)$, with $\epsilon$ being real number constant.

All of the procedures described for N=2 are repeated, till the four new vectors $R_n(k)$ of the optimum codebook are determined. The described procedure is repeated till the obtention of the optimum codebook of the desired size N, which will be a value to a power of two, and which determines also the number of bits of each index $n_{min}$ used for coding of vectors R(k) in transmission.

It is worth noting that different criteria can be used to establish the number of iterations NI for a given codebook size; e.g. NI can be determined as desired; or the iterations can be interrupted when the sum of N $mse_n$ values of a given iteration is lower than a threshold; or interrupted when the difference between the sums of N $mse_n$ values of two subsequent iterations is lower than a threshold.

Figure 4:
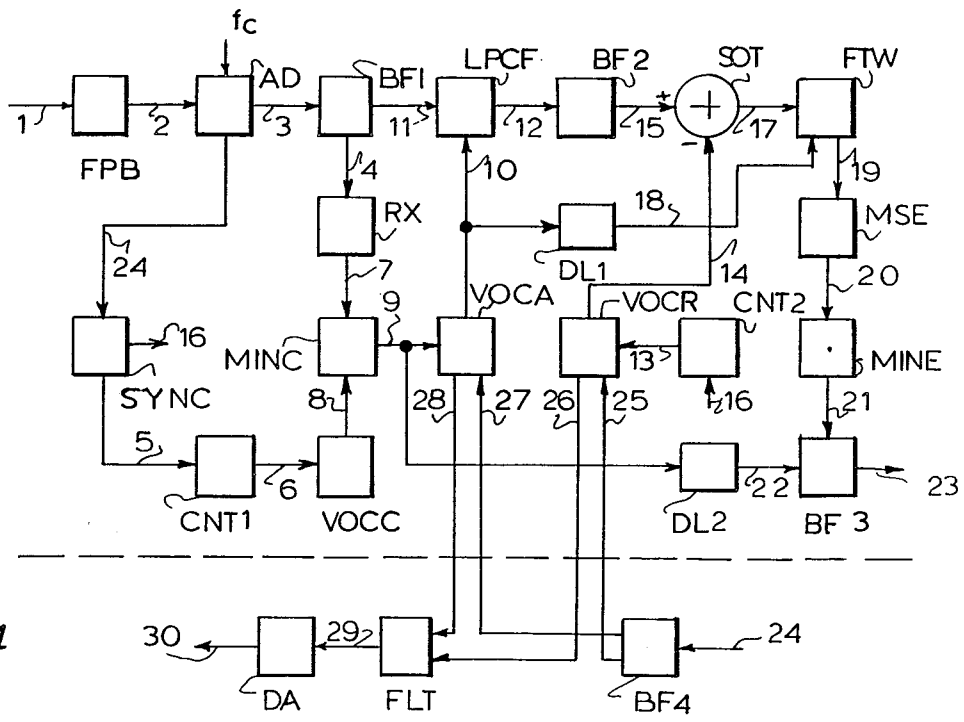
FIG. 4 is a block diagram of the device for coding in transmission and decoding in reception.

Referring now to FIG. 4, we will first describe the structure of the coding section of the speech signal in transmission whose circuit blocks are drawn above the dashed line delimiting between transmission and reception sections.

The low-pass filter FPB has a cutoff frequency of 3 kHz for the analog speech signal it receives over wire 1.

The output from the low-pass filter is fed to the analog-to-digital converter AD over wire 2. AD utilizes a sampling frequency fc=6.4 kHz and obtains speech signal digital samples x(j) which are also subdivided into subsequent blocks of J=128 samples; this corresponds to a subdivision of the speech signal into time intervals of 20 ms.

The block BF1 contains two conventional registers with capacity of F=192 samples received on connection 3 from converter AD. In correspondence with each time interval identified by analog-to-digital converter AD, the registers BF1 temporarily store the last 32 samples of the preceding interval, the samples of the present interval and the first 32 samples of the subsequent interval; this high capacity of BF1 is necessary for the subsequent weighting of blocks of samples x(j) according to the above-mentioned superposition technique between subsequent blocks.

At each interval a register of BF1 is written by converter AD to store the samples x(j) generated, and the other register, containing the samples of the preceding interval, is read by block RX; at the subsequent interval the two registers are interchanged. In addition the register being written supplies on connection 11 the previously stored samples which are to be replaced.

It is worth noting that only the J central samples of each sequence of F samples of the register of BF1 will be present on connection 11. Reader RX is a circuit weighting samples x(j), which it reads from BF1 through connection 4 according to the superposition technique, and calculates autocorrelation coefficients $C_x(j)$, defined in equation (5), which it supplies on connection 7.

The connection 7 feeds a minimum-value calculation MINC connection also to a read-only-memory VOCC containing the codebook of vectors of autocorrelation coefficients $C_a(i,h)$ defined in equation (6), which it supplies on connection 8, according to the addressing received from a counter CNT1.

The counter CNT1 is synchronized by a suitable timing signal it receives on wire 5 from the synchronization generator SYNC. Counter CNT1 emits on connection 6 the addresses for the sequential reading of coefficients $C_a(i,h)$ from the ROM VOCC.

The minimum-value calculator MINC is a block which, for each coefficient $C_a(i,h)$ it receives on connection 8, calculates the numerator of the fraction is equation (4), using also the coefficient $C_x(i)$ present on connection 7. The minimum-value calculator MINC compares with one another, H distance values obtained for each block of samples x(j) and supplies on connection 9 the index $h_{ott}$ corresponding to the minimum of said values.

Line 9 feeds a read-only-memory or ROM which contains the codebook of linear-prediction coefficients $a_h(i)$ in the one-to-one correspondence with coefficients $C_a(i,h)$, present in the ROM VOCC. The ROM VOCA receives from the minimum-value calculator MINC on connection 9 the indices $h_{ott}$ defined hereinbefore as reading addresses of coefficients $a_h(i)$ corresponding to $C_a(i,h)$ values which have generated the minima calculated by the minimum-value calculator MINC.

A vector of linear-prediction coefficients $a_h(i)$ is then read from VOCA at each 20 ms time interval, and is supplied on connection 10 to the LPC inverse filter LPCF.

The LPC inverse filtering of block LPCF is effected according to function (1). On the basis of the values of speech signal samples x(j) it receives from registers BF1 on connection 11, as well as on the basis of the vectors of coefficients $a_h(i)$ it receives from the ROM VOCA on connection 10, the LPC inverse filter LPCF obtains at each interval a residual signal R(j) consisting of a block of 128 samples supplied on connection 12 to register unit BF2.

Register unit BF2, like BF1, is a block containing two registers able to temporarily store the residual signal blocks it receives from the LPC inverse filter LPCF. Also the two registers in the register unit BF2 are alternately written and read according to the technique already described for register unit BF1.

Each block of residual signal R(j) is subdivided into four consecutive residual vectors R(k); the vectors have each a length K=32 samples and are emitted one at a time on connection 15.

The 32 samples correspond to a 5 ms duration. Such time interval allows the quantization noise to be spectrally weighted, as seen above in the description of the method.

The ROM VOCR contains the codebook of quantized residual vectors $R_n(k)$, each of 32 samples.

Through the addressing supplied on connection 13 by a counter CNT2, the read-only-memory VOCR sequentially supplies vectors $R_n(k)$ on connection 14. CNT2 is synchronized by a signal emitted by synchronizing circuit SYNC over wire 16.

Subtractor SOT effects a substraction, from each vector R(k) present in a sequence on connection 15, of all the vectors $R_n(k)$ supplied by ROM VOCR on connection 14.

The subtractor SOT obtains for each block of residual signal R(j) four sequences of quantization error vectors $E_n(k)$ which it emits on connection 17 to the filter FTW.

The filter FTW is a block filtering vector $E_n(k)$ according to a weighting function W(z) as defined in equation (3).

Filter FTW previously calculates a coefficient vector $\gamma^i a_h(i)$ starting from a vector $a_h(i)$ it receives through connection 18 from delay circuits DL1 which delays, by a time equal to an interval, the vectors $a_h(i)$ which it receives on connection 10 from ROM VOCA. Each vector $\gamma^i a_h(i)$ is used for the corresponding block of residual signal R(j).

To filter FTW supplies at the output on connection 19 filtered quantization error vectors $\hat{E}_n(k)$ to a mean-square-error calculator MSE.

The calculator MSE calculates a weighted mean-square error $mse_n$, as defined in equation (2), corresponding to each vector $\hat{E}_n(k)$, and supplies it on connection 20 with the corresponding value of index n to the minimum value calculator MINE.

In the minimum-value calculator MINE the minimum of values $mse_n$ supplied by the mean square error calculator MSE is identified for each of the four vectors R(k); the corresponding index is supplied on connection 21 to output register BF3. The four indices $n_{min}$, corresponding to a block of residual signal R(j), and index $h_{ott}$ present on connection 22 are thus supplied to the output register BF3 and form a coding word of the corresponding 20 ms speech signal interval, which word is then supplied to the output on connection 23.

Index $h_{ott}$ which was present on connection 9 in the preceding interval, is present on connection 22, delayed by an interval by a delay circuit DL2.

The structure of the decoding section for reception, composed of circuit blocks BF4, FLT, DA drawn below the dashed line, will be now described.

The register BF4 temporarily stores speech signal coding words received on connection 24. At each interval, the register BF4 supplies index $h_{ott}$ on connection 27 and the sequence of indices $n_{min}$ of the corresponding word on connection 25. Indices $n_{min}$ and $h_{ott}$ are carried as addresses to memories VOCR and VOCA and allow selection of quantized-residual vectors $R_n(k)$ and quantized coefficient vectors $a_h(i)$ to be supplied to filter FLT.

Filter FLT is a linear-prediction digital-filter implementing the aforedescribed transfer function S(z).

Filter FLT receives coefficient vectors $a_h(i)$ through connection 28 from memory VOCA and quantized-residual vectors $R_n(k)$ on connection 26 from memory VOCR, and supplies on connection 29 quantized digital samples $\hat{x}(j)$ of reconstructed speech signal, which samples are then supplied to digital-to-analog converter DA which supplies on wire 30 the reconstructed speech signal.

The synchronizing circuit SYNC denotes a block apt to supply the circuits of the device shown in FIG. 4 which timing signals. For simplicity sake, however, the FIGURE shows only the synchronism signals supplied to the two counters CNT1, CNT2 (via wires 5 and 16).

Register BF4 of the receiving section will require also an external synchronization, which can be derived from the line signal, present on connection 24, with usual techniques which do not require further explanations.

The synchronizing circuit SYNC is synchronized by a signal at a sample-block frequency arriving from analog-to-digital converter AD on wire 24.

From the short description given hereinbelow of the operation of the device of FIG. 4, the person skilled in the art can implement circuit SYNC.

Each 20 ms time interval comprises a transmission coding phase followed by a reception decoding phase.

At a generic interval s during a transmission coding phase, the A/D converter AD generates the corresponding samples x(j), which are written into a register of the unit BF1, while the samples of interval (s−1), present in the other register of the unit BF1, are processed by Rx which, cooperating with blocks MINC, CNT1 and VOCC, allows index $h_{ott}$ to be calculated for an interval (s−1) and supplied on connection 9; hence the filter LPCF determines the residual signal R(j) of the samples of interval (s−1) received by register unit BF1. The residual signal is written into a register of the unit BF2, while residual signal R(j) relevant to the samples of interval (s−2), present in the other register of unit BF2, is subdivided into four residual vectors R(k), which, one at a time, are processed by the circuits downstream of register unit BF2, to generate on connection 21 the four indices $n_{min}$ relating to interval (s−2).

It is worth noting that at interval s, coefficients $a_h(i)$ relating to interval (s−1) are present at the delay DL1 input, while those of interval (s−2) are present at the output of the delay circuit DL1; index $h_{ott}$ relating to interval (s−1) is present at the delay DL2 input, while that relating to interval (s−2) is present at the output of delay DL2.

Hence, indices $h_{ott}$ and $n_{min}$ of interval (s−2) arrive at register BF2 and are then supplied on connection 23 to constitute a code word.

During the reception decoding phase, which takes place during the same interval s, register BF4 supplies on connections 25 and 27 the indices of a just received coding word. These indices address memories VOCR and VOCA which supply the relevant vectors to filter FLT which generates a block of quantized digital samples $\hat{x}(j)$, which are converted into analog form by digital to analog converter DA to form a 20 ms segment of speech signal reconstructed on wire 30.

Modifications and variations can be made to the just described example of embodiment without going out of the scope of the invention.

For example the vectors of coefficients $\gamma^i a_h(i)$ for filter FTW can be extracted from a further read-only-memory whose contents results in one-to-one correspondence with that of memory VOCA of coefficient vectors $a_h(i)$. The addresses for the further memory are indices $h_{ott}$ present on output connection 22 of delay circuit DL2, while delay circuit DL1 and corresponding connection 18 are no longer required.

By this circuit variant the calculation of coefficients $\gamma^i a_h(i)$ can be avoided at the cost of a memory capacity increase.

What is claimed is:

1. A method of coding and decoding speech signals, comprising the steps of:

(I) coding speech signals by:

(a) subdividing each speech signal into a block of samples x(j), (b) subjecting each block of samples x(j) to linear-prediction inverse filtering with quantized filter coefficient vectors $a_h(i)$ selected from a codebook of said quantized filter coefficient vectors and with a vector of index $h_{ott}$ forming an optimum filter which minimizes a spectral-distance function $d_{LR}$ from among normalized-gain linear-prediction filters, and obtaining a residual signal R(j) subdivided into residual vectors R(k), (c) comparing each of said residual vectors R(k) with each vector of a codebook of quantized residual vectors $R_n(k)$, thereby obtaining N difference vectors $E_n(k)$ where $(1 \leqq n \leqq N)$;

(d) subjecting the N difference vectors $E_n(k)$ obtained in step (I) (c) to filtering with a frequency weighting function W(z) and extracting filtered quantization error vectors $\hat{E}_n(k)$ therefrom;

(e) automatically computing a mean-square error $mse_n$ for each of the filtered quantization error vectors extracted in step (I) (d), and (f) forming the coded speech signal from indices $n_{min}$ of the quantized residual vectors $R_n(k)$ which have generated a minimum value of the mean-square error $mse_n$ computed in step (I) (e) and from the index $h_{ott}$ for each block of samples x(j); and (II) decoding coded speech signals by:

(a) selecting quantized residual vectors $R_n(k)$ having an index $n_{min}$ from said codebook of quantized residual vectors $R_n(k)$, (b) subjecting the selected quantized residual vectors of step (II) (a) to a linear-prediction filtering, and (c) supplying as coefficients for the linear-prediction filtering of step (II) (b), vectors $a_h(i)$ having the index $h_{ott}$ to thereby obtain quantized digital samples $\hat{x}(j)$ of a reconstructed speech signal.

2. The method defined in claim 1 wherein said frequency weighting function W(z) is a linear prediction filtering whose coefficients are vectors $\gamma^i.a_h(i)$, where $\gamma$ is a constant and $a_h(i)$ are vectors of quantized filter coefficients having index $h_{ott}$.

3. The method defined in claim 1 wherein said quantized filter coefficients are linear prediction coefficients.

4. The method defined in claim 1, further comprising the step (III) of generating said codebook of quantized residual vectors $R_n(k)$ by:

(a) generating a set of residual vectors R(k) in a training speech-signal sequence, (b) writing two initial quantized-residual vectors $R_n(k)$ in said codebook of quantized residual vectors, where N=2, (c) effecting between said residual vectors R(k) and said initial quantized-residual vectors $R_n(k)$ comparisons to obtain said difference vectors $E_n(k)$, subsequent filtering according to frequency-weighting function W(z), calculations of said mean-square errors $mse_n$, and then each residual vector R(k) is associated with quantized-residual vector $R_n(k)$ which has generated minimum value $mse_n$, obtaining N subsets of residual vectors R(k), (d) for each subset, calculating a centroid vector $\hat{R}_n(k)$ for relevant residual vectors R(k) weighted with weighting coefficients $P_m$ derived from the ratio between the energies associated with vectors $\hat{E}_n(k)$ and $E_n(k)$, where m is the index of residual vector R(k) of the subset, said centroid vectors $\hat{R}_n(k)$ forming a new codebook of quantized-residual vectors $R_n(k)$ replacing a preceding one, (e) carrying out steps (III) (c), and (III) (d), are carried out NI consecutive times, obtaining an optimum codebook for N=2, (f) doubling the number of quantized residual vectors $R_n(k)$ of the codebook by adding to those already present, a number of vectors obtained by multiplying the already existing vectors by a constant factor $(1+\epsilon)$, and (g) repeating the operations of (III) (c), (III) (d), (III) (e), and (III) (f) to obtain a codebook of a selected size.

5. An apparatus for the coding and decoding of speech signals, comprising:

for coding of speech signals:

(a) a low-pass filter receiving at an input thereof, analog speech signals to be encoded, (b) an analog-to-digital converter connected to an output of said low-pass filter to output blocks of digital samples x(j) representing said analog speech signals, (c) a first register unit connected to an output of said analog-to-digital converter for temporarily storing said blocks of digital samples x(j), (d) a first computing circuit connected to said first register unit and receiving samples therefrom for computing autocorrelation coefficient vectors $C_x(i)$ of digital samples of each block received from said first register unit, (e) a first read-only memory containing H autocorrelation coefficient vectors $C_a(i,h)$ of quantized filter coefficients $a_h(i)$, where $(1 \leqq h \leqq H)$, (f) a first minimum-value calculator connected to said first computing circuit and to said first read-only memory for determining a spectral distance function $d_{LR}$ for each vector of coefficients $C_x(i)$ received from said first computing circuit and for each vector of coefficients $C_a(i,h)$ received from said first read-only memory, and determining a minimum of H values of $d_{LR}$ obtained for each vector of coefficients $C_x(i)$ and supplying to an output of the first minimum-value calculator a corresponding index $h_{ott}$, (g) a second read-only memory connected to said output of the first minimum-value calculator and containing a codebook of the quantized filter coefficients $a_h(i)$ and addressed by the indices $h_{ott}$ from said first minimum-value calculator, (h) a digital inverse first linear-prediction filter connected to an output of said first register unit and to an output of said second read-only memory for receiving said blocks of samples from said first register unit and vectors of coefficients $a_h(i)$ from said second read-only memory, for generating a residual signal R(j), (j) a second register unit connected to said first linear-prediction filter for temporarily storing residual signals R(j) generated by said first linear-prediction filter and outputting residual vectors R(k), (k) a third read-only memory containing a codebook of quantized residual vectors $R_n(k)$, (l) a subtracting circuit connected to said second register unit and to said third read-only memory for computing for each residual vector R(k) outputted by said second register unit a difference with respect to each vector supplied by said third read-only memory, (m) a digital second linear-prediction filter connected to said subtracting circuit and receiving said differences therefrom for frequency weighting of vectors received from said subtracting circuit, thereby outputting a vector $\hat{E}_n(k)$ of filtered quantization error, (n) a second computing circuit connected to said second linear-prediction filter for calculating a mean-square error $mse_n$ for each vector of filtered quantization error outputted by said second linear-prediction filter, (o) a second minimum-value calculator connected to said second computing circuit and identifying for each residual vector R(k), a minimum mean-square error obtained from the second computing circuit and delivering to an output of the second minimum-value calculator a corresponding index $n_{min}$, and (p) a third register unit connected to said first minimum-value calculator through a delay circuit and connected to said second minimum-value calculator for outputting a coded signal for each block of samples in the form of the respective indices $n_{min}$ and $h_{ott}$; and for decoding of speech signals:

(q) a fourth register unit for receiving a coded speech signal to be decoded and connected to said second and third read-only memories for temporarily storing the coded speech signal to be decoded and supplying the indices $h_{ott}$ thereof as addresses to said second read-only memory and the indices $n_{min}$ thereof as addresses to said third read-only memory, (r) a digital third linear-prediction filter connected to said second and third read-only memories for receiving respectively vectors of the coefficients $a_h(i)$ and quantized residual vectors $R_n(k)$ as addressed by said fourth register unit and outputting corresponding digital samples, and (s) a digital-to-analog converter connected to said third linear-prediction filter and receiving the digital samples outputted thereby, for supplying decoded analog speech signals.

6. The apparatus defined in claim 5 wherein the digital filter computes its vectors of coefficients $\gamma^i.a_h(i)$ by multiplying by constant values $\gamma^i$ the coefficient vectors $a_h(i)$ it receives from said second memory through a second delay circuit.

7. The apparatus defined in claim 5 wherein said second digital filter receives the corresponding vectors of coefficients $\gamma^i.a_h(i)$ from a fourth read-only-memory addressed by said indices $h_{ott}$ present at the output of the first-mentioned delay circuit.

* * * * *